US005524945A

United States Patent [19]

Georgopoulos et al.

[11] Patent Number: 5,524,945

[45] Date of Patent: Jun. 11, 1996

[54] THERMOPLASTIC SECURITY SEAL

[75] Inventors: George Georgopoulos, Pine Brook; George A. Lundberg, Jr., Kinnelon; Louis J. Mattos, Carteret, all of N.J.

[73] Assignee: E. J. Brooks Company, Newark, N.J.

[21] Appl. No.: 221,590

[22] Filed: Apr. 6, 1994

[51] Int. Cl.[6] ..... B65D 63/00

[52] U.S. Cl. ..... 292/307 A; 24/30.5 P; 24/16 PB; 24/17 AP; 292/318; 292/322; 292/307 R

[58] Field of Search ..... 292/307 R, 307 A, 292/307 B, 319, 320, 321, 322, 323, 324, 325, 310, 311, 312, 313; 24/16 PB, 17 AP, 30.5 P, 484

[56] References Cited

U.S. PATENT DOCUMENTS

| | | | |
|---|---|---|---|
| 1,930,560 | 10/1933 | Reidel | 292/318 |
| 2,103,743 | 12/1937 | Doty | 292/307 R |
| 3,556,575 | 1/1971 | Farkas | 292/307 R |
| 3,588,961 | 6/1971 | Farago | 24/16 PB |
| 3,588,963 | 6/1971 | Moberg . | |
| 3,830,538 | 8/1974 | Moberg . | |
| 3,944,269 | 3/1976 | Lundberg . | |
| 4,001,919 | 1/1977 | Moberg . | |
| 4,214,349 | 7/1980 | Munch | 24/16 PB |
| 4,470,173 | 9/1984 | Adamson | 24/17 AP |
| 4,537,432 | 8/1985 | Meeks | 24/16 PB |
| 5,102,075 | 4/1992 | Dyer | 24/30.5 P |
| 5,123,686 | 6/1992 | Wenk | 292/307 R |
| 5,183,301 | 2/1993 | Lundberg . | |
| 5,382,061 | 1/1995 | Swift et al. | 292/311 |

FOREIGN PATENT DOCUMENTS

| | | | |
|---|---|---|---|
| 0398562 | 11/1990 | European Pat. Off. | 24/16 PB |
| 2632431 | 12/1989 | France | 292/307 R |
| 2442747 | 4/1975 | Germany | 24/16 PB |
| 3906386A1 | 9/1990 | Germany . | |

*Primary Examiner*—Darnell M. Boucher

[57] ABSTRACT

A one piece molded thermoplastic, preferably polypropylene, high security seal for coin bags has a locking socket body from which a flag extends on one side and a rectangular flat elongated shackle extends on the opposite side via an intermediate flat member which has a tear band there across for selectively separating the member into two pieces to facilitate removal of the locked seal. The shackle has several locking circular segment teeth in two parallel linear arrays on opposite edges of the shackle adjacent to a tamper resistant flange at the member end. A locking sheet metal stamped insert has two sets of tangs defining two spaced tooth receiving openings in a socket locking cavity aligned with shackle receiving openings in the body. The body receives the insert transverse to the shackle insertion direction through a cavity side wall later sealed with a flap formed in the seal body. The locked shackle precludes removal of the insert should the side wall seal be tampered with. The locked shackle forms a closed loop passed through an aperture in the bag folded neck. A hook on the intermediate member forms a tear band tab and engages the bag neck in the seal locked condition.

17 Claims, 6 Drawing Sheets

THERMOPLASTIC SECURITY SEAL

This invention relates to seals, and more particularly, to thermoplastic seals with a locking socket and elongated toothed shackle attached at one end to the socket for engaging and locking the shackle to the socket.

Security seals of the type with shackles and ribs or recesses forming teeth which engage a locking socket are known and are shown, for example in U.S. Pat. Nos. 5,183,301; 3,944,269; 3,588,963; 4,001,919 and 3,830,538. Disclosed in the patents are seals with elongated shackles for engagement with a seal locking socket. The shackles include locking shoulders to facilitate locking to elements in the seal socket. In U.S. Pat. No. 5,183,381 the socket includes a locking latch.

Other arrangements include metal locking inserts which are in the socket cavity and which have locking tangs which engage shoulders or teeth on the shackles for obtaining one way clutch locking of the shackles, the above patents illustrating thermoplastic locking elements in the socket. The problem with metal locking inserts is that these need to be inserted into the locking socket and sealed to the socket body. Prior art arrangements use a circular metal insert disc which is inserted into a locking socket cavity in the same axial direction in which the shackle is inserted into the socket to lock the shackle to the insert. After the metal insert is placed in the cavity, the cavity is sealed closed with a plastic disc aligned over the circular metal insert and bonded to the plastic body rim forming an annular bonding seam which encircles the locked shackle.

After the shackle is inserted into the socket and locked in place, the present inventors recognize it is relatively easy to cut the plastic disc free at the annular bond seam. This leads to defeating the seal by removing the insert and then later replacing the insert after access to the restricted area is obtained and gluing the plastic disc in place to avoid obvious tampering. One on going problem in which seals are used to secure bags, hasps, latches and the like is to provide obvious evidence of tampering. It is known, for example, that most seals can be broken into. However, what is desired is obvious evidence that the seal was tampered with. Therefore, such seals must not only provide good security that is not easily defeated, but obvious visible evidence of tampering if the seal is tampered with. The present invention is directed to a solution of this problem.

In a seal in accordance with one embodiment of the present invention for securing an element and including a body with a locking socket and a shackle extending from the body and having a free end insertable into and engagable with the socket for locking the shackle to the body and to the element, the socket including a metal locking insert having a locking tang for engaging and locking the inserted shackle, the combination comprising a thermoplastic molded body having a cavity and a flexible molded thermoplastic shackle extending from the body in a first longitudinal direction, the body having a first opening therein in communication with the cavity in a second direction transverse the first direction, the opening for receiving the shackle in the second direction and for permitting the received shackle to be inserted into the cavity. The cavity is defined by a bottom and top wall at least one of which has the first opening and a plurality of sidewalls between the top and bottom walls for enclosing the cavity at respective cavity sides, the body having a second opening at one of the cavity sides for receiving the insert therethrough in a direction transverse the second direction.

As a result, the insert is inserted transversely into the cavity of the socket relative to the direction of insertion of the shackle. The insertion opening is sealed shut with the insert in the cavity. When the shackle is inserted through the insert locking opening, the shackle is normal to the direction in which the insert is inserted into the cavity. Therefore, if the seam of the opening through which the insert was inserted into the cavity is later cut, the shackle passing through the insert precludes transverse disengaging the insert from locking engagement with the shackle. Any attempt to cut the socket body beyond the seam sealing the insert in place at a side of the insert cavity produces obvious evidence of tampering and once so tampered with, is not easily later hidden.

A seal in accordance with a second embodiment of the present invention comprises a body with a locking socket for locking a shackle inserted therein in an insertion direction and arranged for one way displacment of the shackle in the locking socket to preclude withdrawal of the shackle from the socket opposite the insertion direction. The shackle is integral with and extends from the body at one shackle end and has a locking portion, the shackle having opposing edges, the shackle including an array of locking teeth on each of the edges in the locking portion.

A seal according to a further embodiment of the present invention comprises a body with a locking socket for locking a shackle inserted therein in an insertion direction and arranged for one way displacment of the shackle in the locking socket to preclude withdrawal of the shackle from the socket opposite the inserton direction. The shackle is integral with and extends from the body at one shackle end and has a locking portion. A tear band is formed in the shackle between the locking portion and the body to permit the shackle to be separated from the body to remove the locked seal.

IN THE DRAWING

Figure 1:
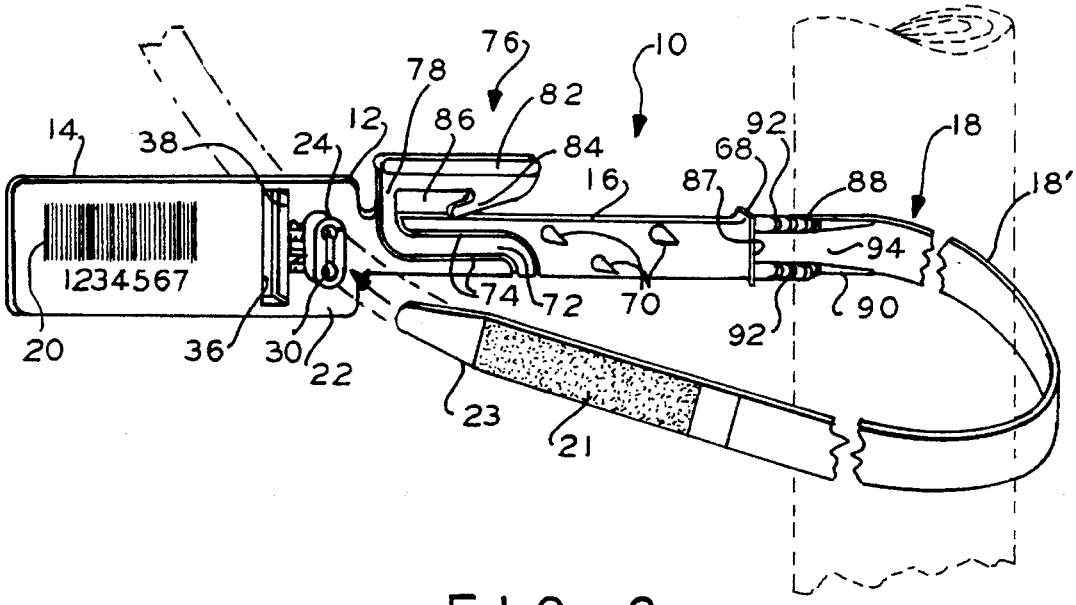
FIG. 1 is an isometric view of a thermoplastic molded security seal prior to locking the seal in accordance with one embodiment of the present invention.
Figure 4:
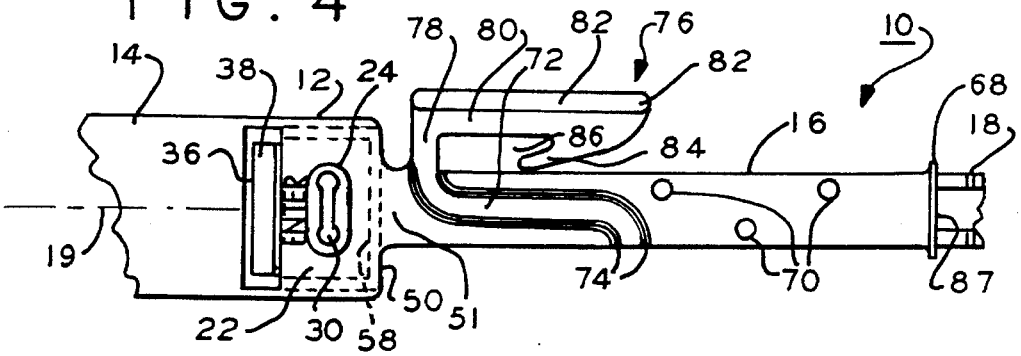
FIG. 4 is a more detailed view of a portion of the seal of FIG. 2.
Figure 8:
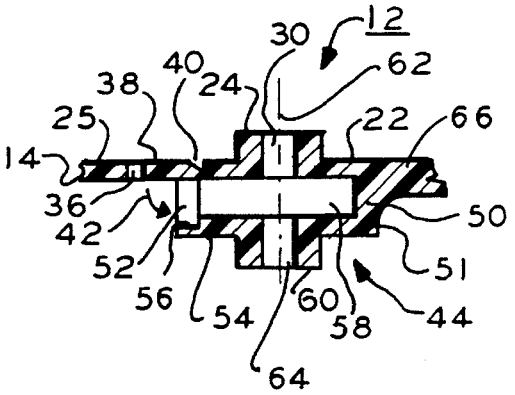
FIG. 8 is a side elevation sectional view of the seal of FIG. 6 taken along lines 8—8.
Figure 9:
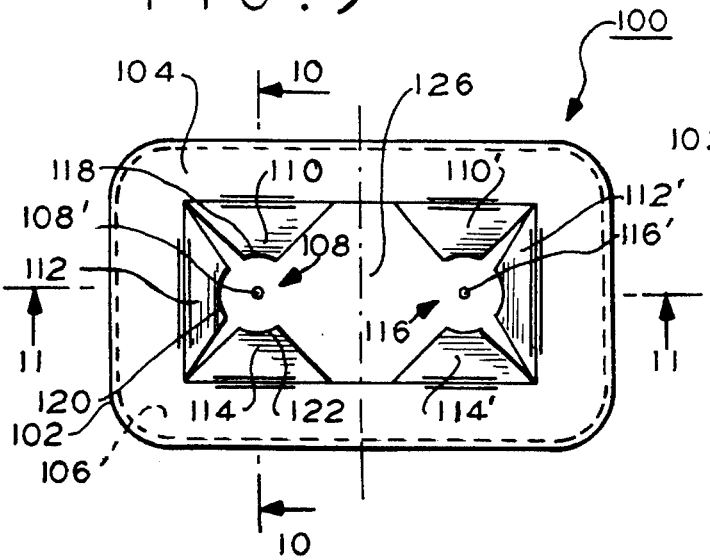
FIG. 9 is a plan view of an insert employed with the embodiment of FIG. 1.
Figure 10:
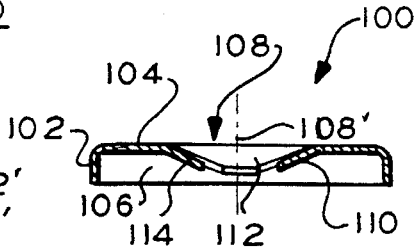
Figure 11:
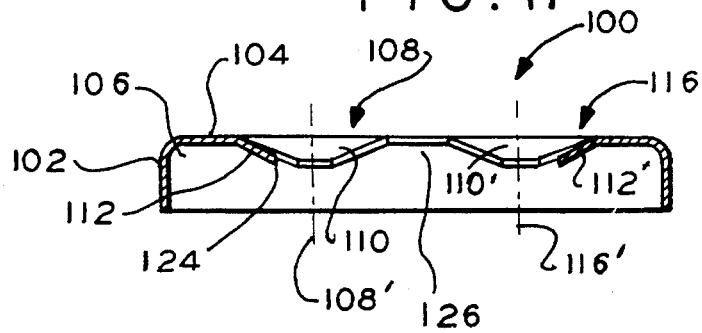
Figure 12:
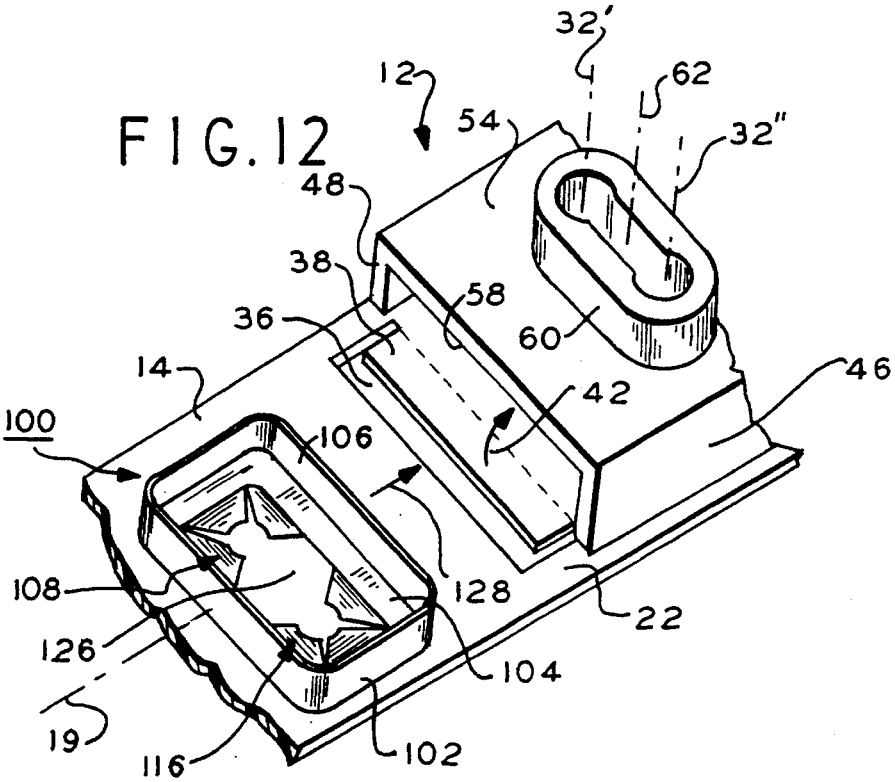
Figure 13:
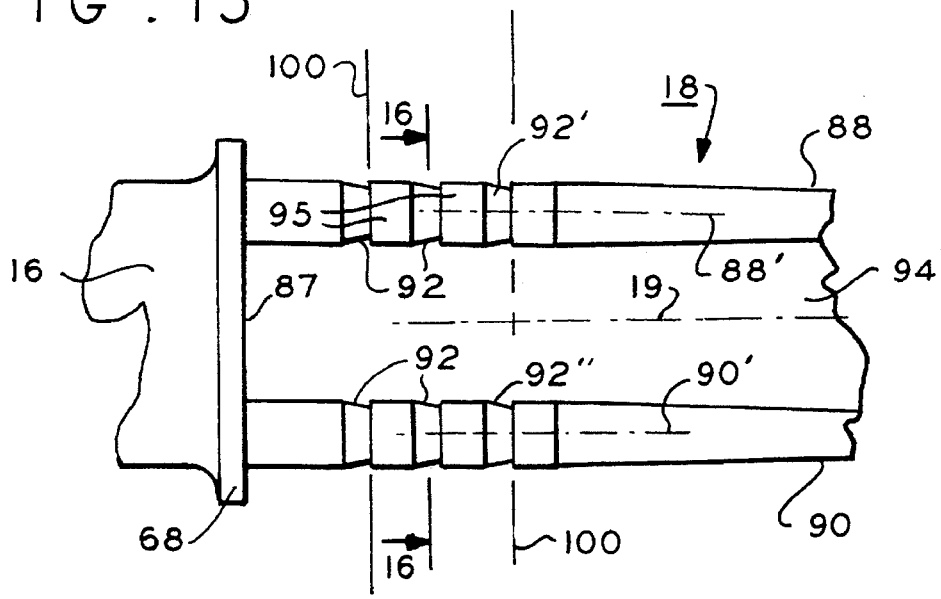
Figure 14:
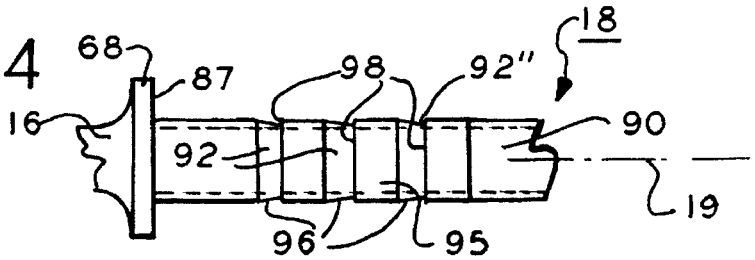
Figure 15:
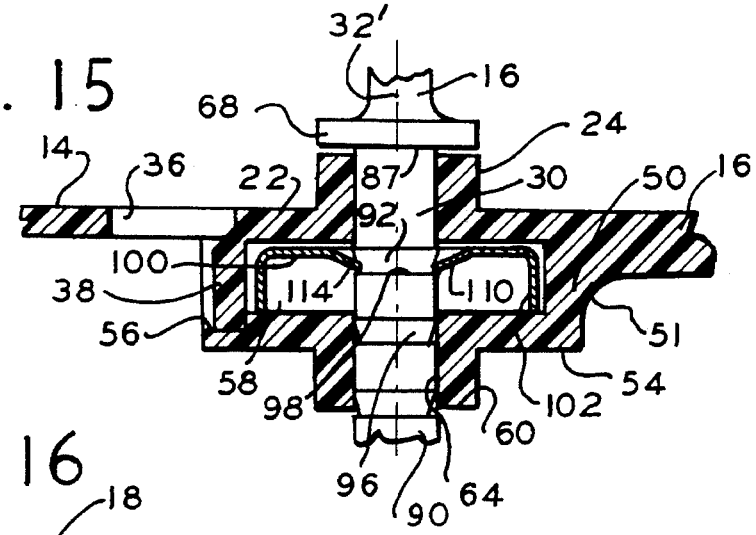
Figure 16:
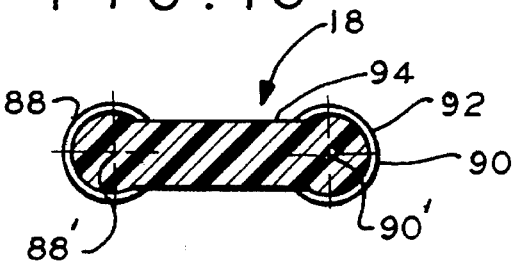
Figure 21:
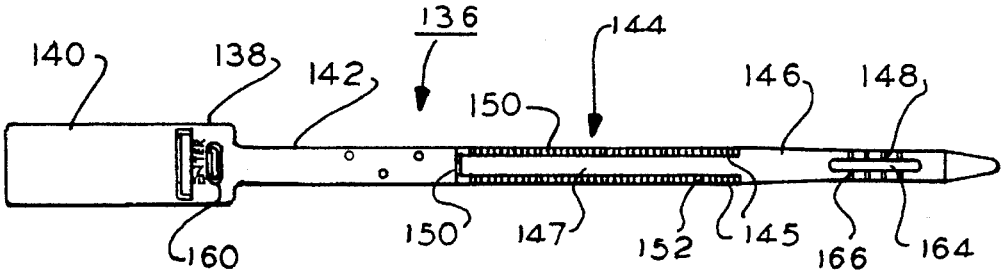
Figure 22:
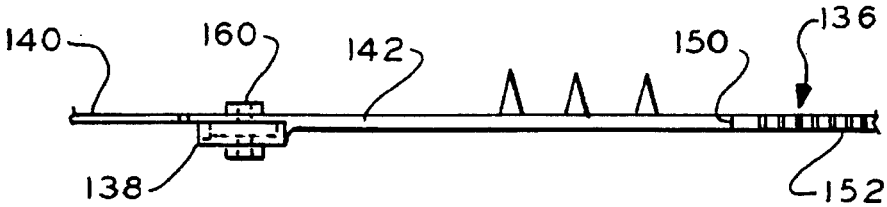
Figure 23:
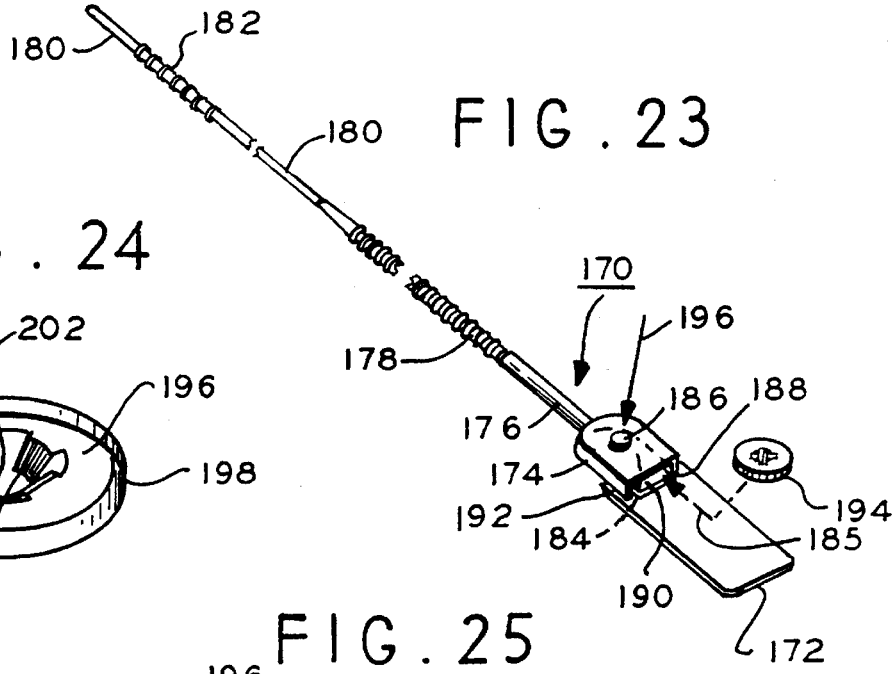
Figure 24:
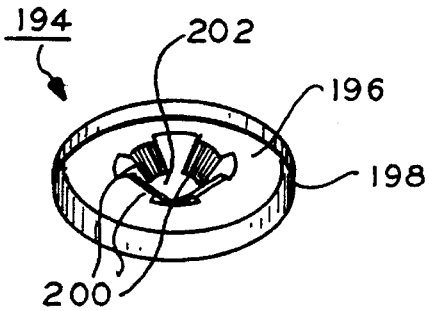
Figure 25:
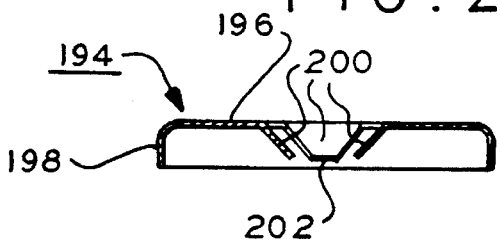

FIGS. 10 and 11 are respective side and front elevation sectional views of the insert of FIG. 9 taken along respective lines 10—10 and 11—11;

FIG. 12 is an isometric view of the insert of FIG. 9 about to be inserted into the cavity of the seal body of FIG. 4;

FIG. 13 is a plan view of a portion of the shackle of the embodiment of FIG. 1 showing locking ribs formed by grooves;

FIG. 14 is a side elevation view of the portion of FIG. 13;

FIG. 15 is a sectional elevation view similar to the view of FIG. 8 showing the seal of FIG. 1 in the locked state;

FIG. 16 is a sectional elevation view of the shackle of FIG. 13 taken along lines 16—16;

FIGS. 17–20 are isometric views of the seal of FIG. 1 in various stages of locking the seal to a bag;

FIGS. 21 and 22 are respective plan and side elevation views of a seal according to another embodiment of the present invention;

FIG. 23 is an isometric exploded view of a seal according to a further embodiment of the present invention; and FIGS. 24 and 25 are respective isometric and side elevation sectional views of the insert used in the seal of FIG. 23.

Figure 2:
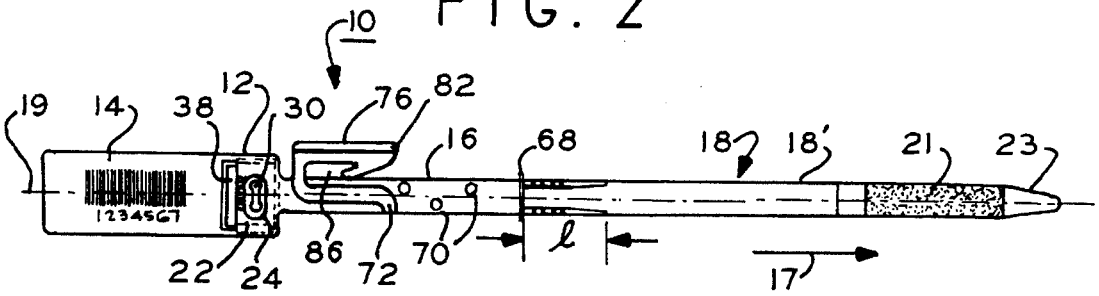
FIG. 2 is a plan view of the seal of FIG. 1 during an intermediate stage prior to insertion of a locking insert into the seal locking socket.
Figure 3:
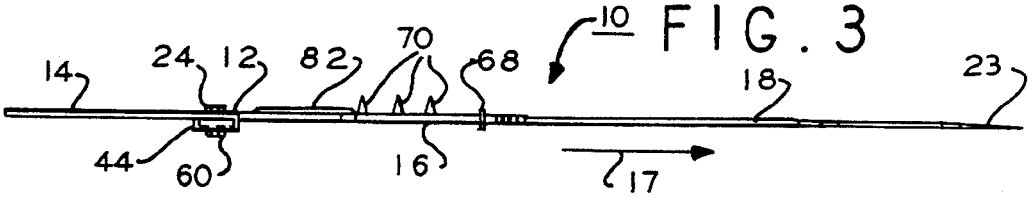
FIG. 3 is a side elevation view of the seal of FIG. 2.

In FIGS. 1–3, security seal 10 comprises a relatively rigid molded thermoplastic body 12, preferably polypropylene, a somewhat rigid planar sheet flag 14 extending from the body 12 in one direction therefrom, an elongated flexible sheet member 16 axially extending from the body in a direction opposite the flag 14 and a flexible shackle 18 axially extending from member 16 on a member 16 end opposite the body 12, all being molded as a one piece integral unit. The entire molded seal 10 structure is elongated and extends in an axial direction 17 along axis 19. The flag 14 is a flat elongated relatively wide thin structure for receiving indicia 20 such as a bar code or other data on one or both broad surfaces thereof.

Figure 6:
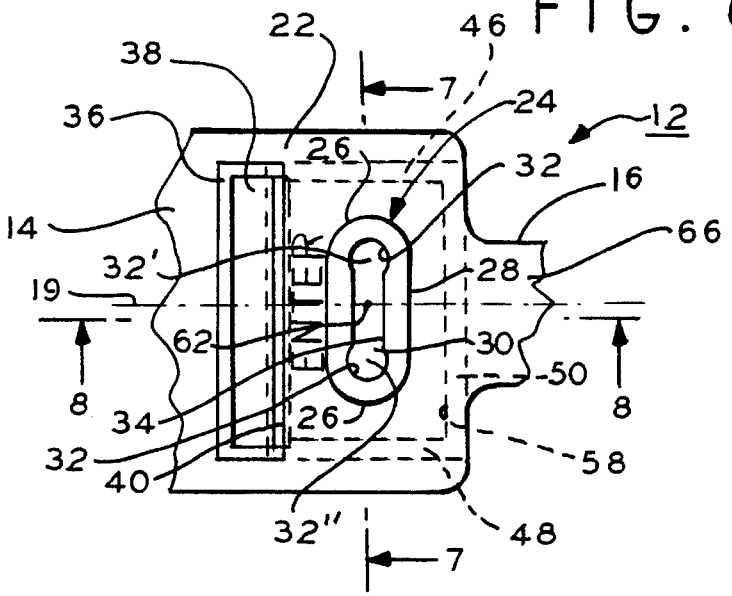
FIG. 6 is an enlarged plan view of a further portion of the seal of FIG. 4 taken along lines 6—6 of FIG. 5.
Figure 7:
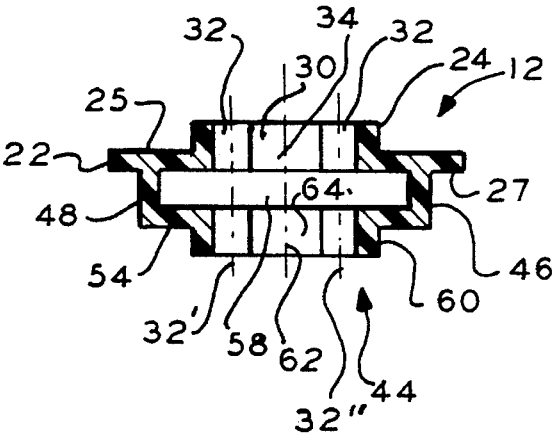
FIG. 7 is a side elevation sectional view of the seal of FIG. 6 taken along lines 7—7.

The body 12, FIGS. 6–8, is integral with and part of flag 14 which forms a body 12 wall 22 coplanar with the flag 14. The body 12 includes an upstanding elongated projection 24 on one side 25 of the wall 22. Projection 24 has two circular end segments 26 and a straight elongated central segment 28 with an opening 30 passing through the projection 24 and wall 22. The opening 30 has two like end circular segments 32 coupled by a central straight segment 34. Segments 32 define respective axes 32' and 32" extending along the opening 30 and a central axis 62.

The wall 22, in the as molded intermediate state, has a U-shaped opening 36 with rectilinear sides forming a rectangular flap 38. A V-shaped groove 40 is formed in side 25 of wall 22 forming a hinge for flap 38. Flap 38 is rotatable in direction 42, FIG. 8, about the hinge to form the completed seal 10 of FIG. 1, as will be explained. A socket 44 depends from wall 22 side 27. The socket 44 has three side walls 46, 48 and 50 depending from wall 22, walls 46 and 48 being rectangular and opposing each other and identical. Wall 50 is opposite rectilinear opening 52 which forms a fourth side of the socket 44. Opening 52 is the same dimensions as flap 38 which when rotated in direction 42 to form the completed seal forms a fourth side wall of the socket 44. A socket top wall 54 is connected to and integral with the depending edges of the side walls 46, 48 and 50. A step 56 is formed in top wall 54 in opening 52 for closely receiving the flap 38 as shown in FIG. 15.

The walls 22, 46, 48, 50 and 54 and flap 38 form a socket 44 cavity 58 which is a rectilinear polygon having its long axis extending transverse to axis 19 and having broad surfaces formed by walls 22 and 54. Opening 30 is in communication with the cavity 58. A projection 60 depends from top wall 54. Projection 60 has the same shape as projection 24 and is aligned with projection 24 along axis 62 normal to axis 19 and to the plane of wall 22. Projection 60 has an opening 64 of the identical shape and size as opening 30 in projection 24 and aligned along axis 62 and axes 32' and 32" therewith in communication with cavity 58 forming a continuous approximate hour glass shaped through conduit with opening 30 and cavity 58 along axis 62.

In FIG. 4, elongated intermediate member 16 is somewhat thicker than, but coplanar with flag 14 and wall 22 and narrower than flag 14 in a direction transverse to axis 19. Member 16 extends at one end thereof from walls 22 and 50, wall 50 having a gradual radius 51, FIG. 8, of different wall thickness toward member 16 for reinforcing the attachment of member 16 to wall 50. Member 16 terminates in a transverse flange 68 at an end opposite wall 50. An array of conical pointed projections 70 upstand from member 16.

Figure 5:
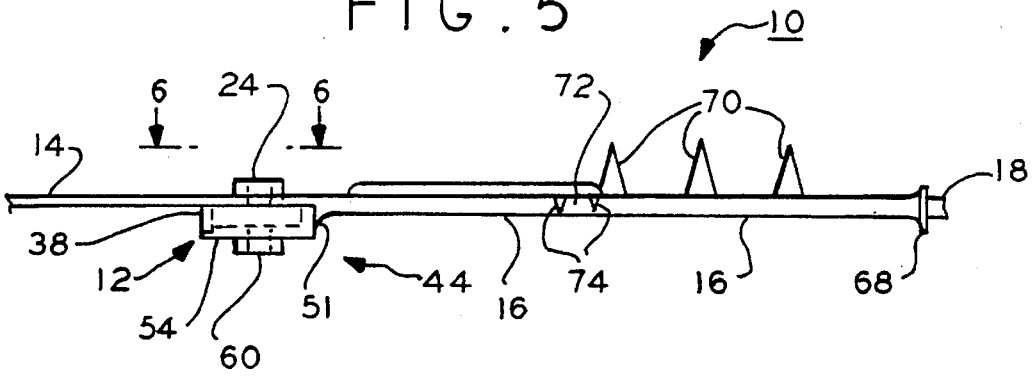
FIG. 5 is a more detailed view of a portion of the seal of FIG. 3.

Between wall 50 and projections 70 is a tear band 72 formed in member 16 transverse axis 19. In FIGS. 4 and 5, tear band 72 is formed in member 16 by two parallel V-shaped grooves 74 formed in one surface of member 16. The grooves 74 are approximately S-shaped as they extend across the member, FIG. 4. The grooves 74 form weakened regions so that band 72 may be easily removed separating member 16 into two pieces on opposite tear band sides. A hook 76 includes a leg 78 which is integral with the tear band 72 between the grooves 74 and is of the same thickness as the member 16. The hook 76 has a body portion 80 parallel to member 16 with a finger gripping flange 82. A hook end member 84 depends from portion 80 opposite leg 78 and extends toward member 16 and leg 78 terminating at its end adjacent to member 16. The hook member 84 because it is molded thermoplastic is flexible and permits objects to be inserted in the hook cavity 86 formed by member 16 and hook 76. The hook 76 conveniently serves a dual function as a tear band tab which is easily grasped for tearing the band 72 at the weakened regions of grooves 74.

Shackle 18 extends along axis 19 from planar surface 87 of flange 68. Shackle 18 is a flat rectangular element in transverse cross section of the same cross sectional area for most of its length. In FIGS. 13 and 14, the shackle 18 has two opposite longitudinal edges 88 and 90 spaced by a rectangular in section mid-section 94. Edges 88 and 90 extend for a relatively short length 1, FIG. 2, and terminate at flange 68 planar surface 92 which is normal to axis 19. The edges 88 and 90 in the region adjacent to flange 68 are approximately semi-circular as best seen in FIG. 16. The circular portion of edges 88 and 90 subtend an arc of about 270°. The diameter of the semi-circular edges 88 and 90 is greater than the thickness of the mid-section 94 so that the edges 88 and 90 and the grooves 92 protrude above and below section 94, FIG. 16. The edges 88 and 90 are each formed with an axially extending array of equally spaced transverse identical grooves 92. The grooves 92, FIG. 14, are of the same shape and comprise a ramp 96 inclined relative to axis 19 toward flange surface 87 and a shoulder 98 at the base of the ramp 96 having a surface lying in plane normal to axis 19 on a side of each groove at the root of the ramp 96.

In this embodiment there are three grooves in each array. The grooves form the edges into an array of circular segment teeth or ribs 95. The grooves at opposite edges, e.g., 92' and 92Δ, FIG. 13, are arranged in opposing pairs with each pair of grooves such as 92' and 92" at opposite edges lying in the same plane and the planes 100 of the groove pairs in the arrays being parallel and normal to axis 19. The grooves 92 are spaced from flange 68 surface 87 a distance so the surface 87 abuts or is substantially close to the projection 24 with the groove 92 closest to the flange 68 in the cavity 58, FIG. 15. The edges 88 and 90 taper to a somewhat conical portion apex in a direction away from the flange 68. The circular portion of edge 88 defines center axis 88' and the circular portion of edge 90 defines center axis 90'. The grooves thus form the edges 88 and 90 into locking transversely aligned rib or tooth pairs in a linear array along the shackle.

The remainder portion 18' FIG. 1, of the shackle 18 beyond circular segment edges 88 and 90 is a flat rectangular sheet with roughened molded opposing surfaces 21, only one being shown, for enhancing hand grasping of the shackle. The tip 23 width tapers to a narrow end as shown. The shackle thickness also tapers to a thinner portion at the shackle end at tip 23, FIG. 3.

In FIGS. 9–12, sheet metal stamped locking insert 100 is preferably 0.005 inch thick (0.127 mm) cold roll steel zinc plated with a clear chromate finish coating. Insert 100 has a rectangular periphery in plan view with rounded corners, FIG. 9. Insert 100 has an outer peripheral flange 102 depending from a planar annular member 104 forming an enclosed space 106. A set 108 of tangs 110, 112 and 114 define a center axis 108', FIG. 9, and a second set 116 of tangs 110', 112' and 114' identical to set 108 but arranged in mirror image relation thereto define a second tang center axis 116'. The tangs 110–114, which are representative, depend from member 104 into space 106 at an incline preferably about 27° from the plane of member 104 and terminate in respective circular segment edges 118, 120 and 122. The edges 118, 120 and 122 define the circle whose center is axis 108'. Because of the tang inclination, the sharp corners 124 of edges 118–122, FIG. 11, face away from member 104. The region between the tangs is open forming opening 126 surrounded by member 104 and the tangs.

The spacing of axes 108' and 116', FIG. 9, is the same as the spacing of the center axes 88' and 90' of the respective edges 88 and 90. These spacings are the same as the center-to-center spacing of the opening 30 portions defined by the circular segments 32, FIGS. 6 and 7, axes 32' and 32".

In FIG. 12, insert 100 is inserted into the cavity 58 in axial direction 128, axis 19, until the insert is fully seated in the cavity as shown in FIG. 15. The insert is closely received in the cavity in the shackle insertion direction along axis 62. This precludes the locked shackle from having vertical play in the direction along axis 62. This minimizes potential tampering with the locking insert 100 with a narrow tool to release the locked shackle. The insert 100 axes 108' and 116' are aligned substantially with the respective projections 24 and 60 openings axes 32' and 32". This centers the tang edges of set 108 about axis 32' and the tang edges of set 116 about axis 32". After the insert 100 is so inserted into cavity 58, the flap 38 is rotated in direction 42, FIG. 12, until the flap seats against the step 56 in the top wall 54, FIG. 15. The joints between the flap and the walls 46, 48 and 54 are then preferably bonded by welding, such as ultrasonic welding or otherwise melting the plastic at the joints to form an integral unitary joint structure. In the alternative, the flap 38 could be bonded with an adhesive.

Figure 17:
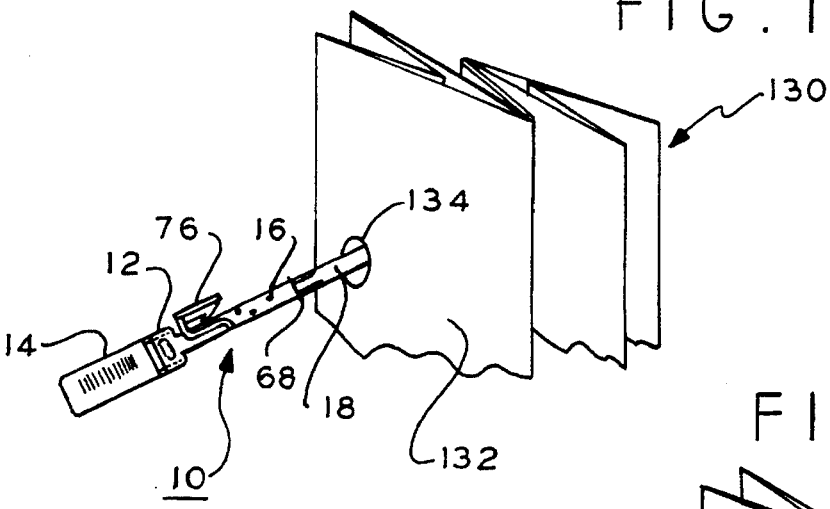
Figure 18:
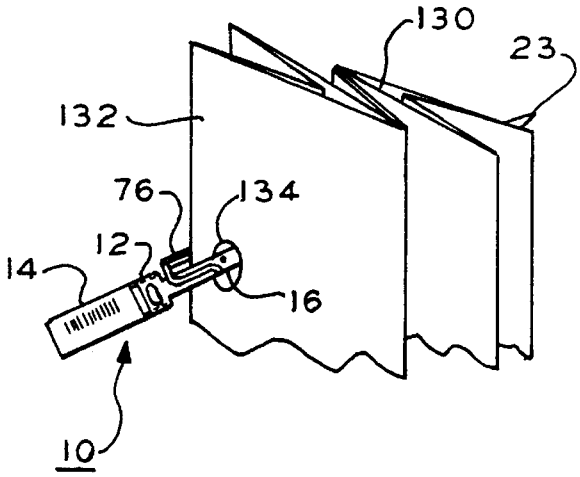
Figure 19:
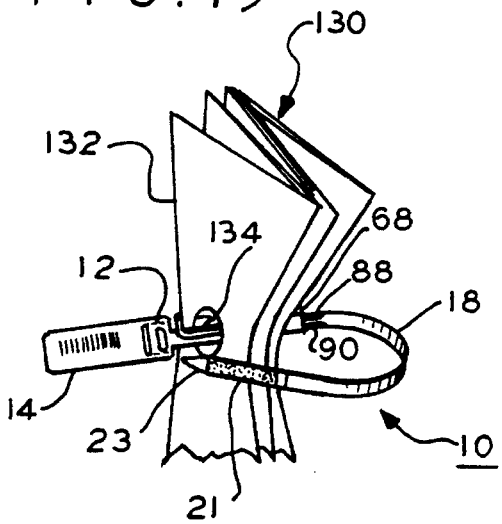

In operation, in FIG. 17, a bag 130 or other article to be sealed has a neck 132 with an aperture 134 therethrough. The shackle 18 of seal 10 is passed through the aperture 134, FIG. 18. The shackle 18 is then wrapped about the neck 132, FIG. 19, and the tip 23 inserted into the opening 30 (FIG. 15) of projection 24. The shackle is then passed through the cavity 58 through the aligned opening 30 of projection 24 and opening 64 of projection 60. A portion of the gathered neck 132 is inserted into the hook 76, FIG. 18. The shackle 18 is then pulled tight through the body 12 until flange 68 abuts the body 12 projection 24, FIG. 15. In this position the tangs of the insert 100 are engaged with a groove 92 on each edge 88 and 90 of the shackle 18 closest to the flange 68.

The corners 124 of edges 118, 120 and 122 of the tang sets 108 and 116 abut the shoulder 98 of each of the corresponding grooves 92 at each shackle edge 88 and 90. The tang edges also are seated at the root of each mating groove 92. The tangs are resilient and resiliently slide over the locking teeth 95. The normal quiescent state of the tangs cause them to engage the groves 92 and seat therein as shown in FIG. 15. Preferably, the bag 130 is a coin bag, but could be any other article requiring sealing. The insert tangs act as a one way clutch permitting the shackle to be inserted therethrough in only one direction. Once so inserted the tangs lock the shackle via the grooves at shoulders 98 precluding removal in the reverse direction.

The tang corners 124 (FIG. 11) are sharp for digging into the shackle if the shackle is attempted to be withdrawn from the body 12 in a direction opposite the shackle insertion direction. The grooves 92 form the edges 88 and 90 into locking ribs or teeth for engaging the tangs in a preferred form. The two sets of ribs or teeth at the opposing edges and two sets of tangs provide enhanced security for locking the shackle in place. Further, this arrangement permits a wide range of shackle dimensions greater than that available with prior art circular cylindrical shackles of the type shown for example in the aforementioned U.S. Pat. No. 3,588,963. These shackles are limited in diameter as the larger the diameter, the larger the locking engaging elements and the greater the insertion forces. There is a limit on such insertion forces and on the diameter of the shackles in practical implementations.

However, using two sets of teeth and mating locking tangs of the present invention, the shackle portion between the teeth formed by grooves 92 and edges 88 and 90 can have different thicknesses and widths without affecting the size of the edges and grooves. For example, in FIG. 16 the distance between axes 88' and 90' may be increased to any desired dimension while keeping the dimensions of the set of edges and grooves constant. Also, the shackle mid-section 94 can have different thicknesses without affecting the circular dimensions of the edges 88 and 90 which can be kept optimal. Section 94 may be thicker than the edge diameters. The insert of course is dimensioned accordingly. Thus the seal 10 provides relatively high security in that the insert is not readily removable without obvious tamper evidence and the dual sets of tangs and locking teeth on the shackle provide increased locking security. For example, during tampering, if a tool is used to force one set of tangs of the insert transversely to disengage the shackle, the other set of tangs lock into the shackle further and preclude withdrawal of the shackle. There is insufficient room to insert two tampering tools through the opening 30 between the projection 24 and shackle 18, FIG. 15. Further, the flange 68 also interferes with insertion of a tampering tool into the opening 30. The projections 70 on member 16 dig into the sealed article to secure the shackle further in a given location on the article.

While grooves 92 forming locking teeth 95 are preferred, it will occur that the tangs of the locking insert 100 with sharp corners 124 will readily dig into and bite relatively softer thermoplastic such as polypropylene, a preferred material for the seal 10. Therefore, the seal will work, but less effectively without the shackle locking teeth. Also, if the corners 124 of the tangs during manufacture are dull due to wear of the tooling producing the insert, such dulling of the tang edges may not readily dig into the shackle and not provide the desired locking integrity without the locking teeth.

Figure 20:
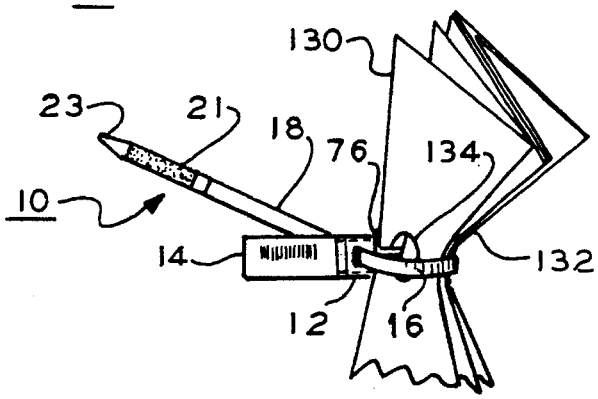

To remove the locked seal 10, FIG. 20, the hook 76 is grasped and pulled to separate the tear band 72, FIG. 4, from member 16. This effectively separates member 16 into two pieces and permits the shackle 18 to be disengaged from the bag aperture 134. The hook 76 in the engaged state of FIG. 20 secures the shackle neatly to the bag neck 132.

In FIGS. 21 and 22, a second embodiment is shown with a seal 136 of integral molded thermoplastic including an insert such as insert 100 of seal 10, FIG. 15. Seal 136 body 138 is substantially identical to body 12 of seal 10. Seal 136 has a flag 140 extending from body 138 at one body side and a member 142 extending from the body opposite side. The member 142 has no tear band, but is dimensioned similarly as member 16, FIG. 1. No flange 68 is present and the shackle 136 is formed with a dual array of semi-circular edges 150 and 152 dimensioned in cross section similarly as edges 88 and 90, FIG. 16. However, the array of grooves in edges 150 and 152, dimensioned similarly as grooves 92 of seal 10, extend for a substantial length of the shackle 144 forming a dual parallel array of teeth 145. The shackle mid-section 147 is slightly thinner than member 142 and the edges 150 and 152 slightly thicker than member 142.

In this way seal 136 is useful with a large number of different article sizes to be sealed whereas the seal 10 of FIG. 1 is limited to a given bag or other article size. Thus seal 10 is fabricated in different models each for a given article size. The shackle of a given seal 10, FIG. 1, has a relatively fixed loop dimension determined for a given implementation. The loop size depends on the length of the member 16 as shown in FIG. 20. The seal 136 of FIG. 21 because of the large length of shackle with teeth has an adjustable loop size in the locked state for accommodating articles of differing dimensions. Shackle 146 has a stop shoulder 150 which engages the projection 160 which limits the insertion of the shackle 144 into the projection 160 opening.

The end portion 148 of shackle 144 has an elongated slot 164 and an axially extending array of upstanding small ribs 166 on opposite sides of the shackle 144. Slot 164 receives a tool (not shown) to assist in manually drawing the shackle tightly about an article to be sealed. The ribs 166 are inserted into the cavity of the body 138 to temporarily hold the shackle 144 to the body 138 via the insert (not shown in these figures) in the body cavity. There is no locking action to the ribs 166 which are easily disengaged from the body 138. The shackle is temporarily secured to the body 138 during handling of the seal 136.

In FIGS. 23, 24 and 25, a further embodiment of the present invention is shown in which in FIG. 23 seal 170 comprises an integral thermoplastic, preferably polypropylene, structure including a flag 172, a body 174, an intermediate member 176, a linear array of circular teeth on shackle 178 and a smaller diameter end portion 180 of the shackle 178 with a tapered end of narrowing configuration. Portion 180 has circular ribs 182 which temporarily secure the shackle 178 to the body 174 locking cavity 184 having a shackle inlet opening 186. The body 174 is relatively flat and U-shaped with a rectilinear opening 188 in communication with cavity 184. A rectangular flap 190 is formed in the wall 192 which is coplanar with planar flag 172. Flap 190 is surrounded on three sides by a U-shaped opening. A groove corresponding to groove 40, FIG. 6 of seal 10, is formed in wall 192 and serves as a hinge for flap 190.

A metal stamped steel thin sheet material insert 194 is inserted into the cavity 184 in direction 185 transverse the shackle 178 insertion direction 196 into opening 186. Insert 194 comprises a circular disc having a disc-like planar wall 196 and a depending outer rim 198. Four symmetrically dimensioned and spaced locking tangs 200 depend from wall 196 centrally thereof. The tangs 200 form a circular opening 202 at the tang edges distal wall 196. The tang edges lock the shackle 178 via the grooves therein forming teeth which are similar in shape as the teeth 95 of seal 10 shackle 18, FIGS. 13 and 14, except the teeth of shackle 178 are circular. The tangs 200 resiliently ride over the teeth of the shackle 178 as the shackle is slid through the opening 202 of the insert in the locking stage with the insert 194 in the cavity 184, FIG. 23.

The insert 194 after assembly to the cavity 184, is secured in the cavity by folding over the flap 190 and sealing it shut closing opening 188 of the cavity 184. The insert 194 is inserted into the cavity 184 transverse to the direction 196 so that any attempt at tampering by cutting the sealed edges of flap 190 does not release the insert because of the presence of the shackle 178 in the insert opening 202, the shackle extending beyond the body 174 in the locked state. Thus any attempt at tampering to remove the insert 194 will provide obvious evidence of such tampering.

Because the shackles are closely received in the cavity egress openings such as opening 30 of seal 10 and opening 186 of seal 170, a tampering tool is not readily inserted through these openings to provide access to the corresponding inserts. The bodies being otherwise integral unitary molded structures are not easily tampered with without leaving tamper evidence.

While particular embodiments have been illustrated herein, these are by way of example and not limitation. Obvious modifications may be made to the disclosed embodiments by one of ordinary skill. The scope of the invention is as defined in the appended claims. For example, the term set in the claims in referring to the tangs includes at least one tang. The term array includes at least two members and has no limit in the number of members forming the array. Also, rectangular and circular cylindrical shackles are disclosed, however, other cross section shapes are intended to be included. Further, the locking cavity while preferably rectangular at least in a portion thereof may be other shapes including circlular, cylindrical or spherical. Preferably, the locking cavity is sealed closed with a hinged flap, a separate member may be used to seal the cavity or may be hinged to the body differently than disclosed. The important aspect is that the locking cavity is sealed at a side thereof in a direction transverse the shackle insertion direction.

What is claimed is:

1. In a seal for securing an element and including a body with a locking socket and a shackle extending from the body and having a free end insertable into and engageable with the socket for locking the shackle to the body and to the element, the socket including a metal locking insert having a locking tang for engaging and locking the inserted shackle, the combination comprising:

a thermoplastic molded body having a cavity;

a flexible molded thermoplastic shackle extending from the body in a first longitudinal direction, said body having a first opening therein in communication with said cavity in a second direction transverse the first direction, said opening for receiving the shackle in the second direction and for permitting the received shackle to be inserted into the cavity;

the cavity being defined by a bottom and top wall at least one of which has said first opening and a plurality of sidewalls between the top and bottom walls for enclosing the cavity at respective cavity sides, the body having a second opening at one of said cavity sides for receiving said insert therethrough in a direction transverse the second direction; and a further sidewall molded with the body and hinged to the body at one sidewall edge the further sidewall having an open state forming the second opening and a closed state for enclosing the cavity one side.

2. The combination of claim 1 wherein the shackle includes at least one locking rib arranged to be positioned in the cavity with the inserted shackle for locking by said insert.

3. The combination of claim 1 further including a metal locking insert in the cavity having at least one locking tang arranged to engage the received shackle for precluding withdrawal of the shackle from the cavity in a direction opposite the second direction, the second opening for permitting the insert to be inserted into the cavity in a direction transverse the second direction and means for securing the further sidewall in the closed state for securing and enclosing the insert in said cavity.

4. The combination of claim 3 wherein said further side wall has a plurality of edges, the means for securing the further sidewall includes means for bonding at least a second of the further edges to the body.

5. The combination of claim 3 wherein said body comprises planar top and bottom walls, said further sidewall being coplanar with one of said top and bottom walls in the open state and normal to the latter one wall in the closed state.

6. The combination of claim 5 wherein the body comprises a planar member extending from and forming the top wall, said further sidewall being coplanar with the planar member which has a transverse groove therein forming a hinge for the further sidewall.

7. The combination of claim 6 wherein the further sidewall is rectangular and is closely received in the second opening.

8. The combination of claim 2 wherein the shackle is an elongated member with a flange, said at least one locking rib being spaced from the flange so that the flange is closely spaced from and extends over the body adjacent to the second opening when the rib is in said cavity.

9. The combination of claim 8 including a hollow projection upstanding from said body and forming a continuation of said first opening, said first opening for closely receiving the shackle.

10. The combination of claim 1 wherein the shackle is an elongated sheet member with two longitudinally extending edges, said shackle having two parallel arrays of spaced locking ribs, each array at a different one of said edges.

11. The combination of claim 10 wherein said arrays of ribs each comprise longitudinally aligned circular segments with said planar sheet member therebetween.

12. The combination of claim 3 wherein the insert comprises a sheet member with an annular sidewall depending from a central wall, said central wall having a plurality of tangs depending therefrom and forming a third opening aligned with the second opening for receiving the shackle therethrough.

13. The combination of claim 12 wherein the third opening comprises two spaced sets of tangs each having edges defining a Circular opening therebetween, the second opening comprising an elongated central region with circular portion end regions extending transversely the second direction.

14. The combination of claim 1 wherein the body includes a member extending therefrom in the longitudinal direction, said shackle extending from the member, said member including a tear band formed therein with weakened regions for selectively separating the shackle from the body.

15. The combination of claim 1 wherein the body includes a member extending therefrom in the longitudinal direction, said shackle extending from the member, said member including a hook for attachment to an element to which the seal is to be secured.

16. The combination of claim 15 wherein said member includes a tear band formed therein with weakened regions for selectively separating the shackle from the body, said hook being integral with the tear band for forming a tear tab for the tear band.

17. The combination of claim 1 wherein said shackle comprises an elongated cylindrical member, said member including a longitudinally extending array of spaced annular locking ribs, said cavity including an annular metal insert with a third opening therein formed by a plurality of locking tangs, the third opening being aligned with the first opening.

* * * * *